US005373992A

United States Patent [19]

Reiter

[11] Patent Number: 5,373,992

[45] Date of Patent: Dec. 20, 1994

[54] ARMATURE CONNECTION FOR AN ELECTROMAGNETICALLY ACTUATABLE VALVE

[75] Inventor: Ferdinand Reiter, Markgroeningen, Germany

[73] Assignee: Robert Bosch GmbH, Stuttgart, Germany

[21] Appl. No.: 508,630

[22] Filed: Apr. 13, 1990

[30] Foreign Application Priority Data

Jul. 29, 1989 [DE] Germany ..... 3925212

[51] Int. Cl.[5] ..... F02M 51/06

[52] U.S. Cl. ..... 239/585.4; 239/600; 239/900; 285/405

[58] Field of Search ..... 239/585.1, 585.4, 900, 239/600; 285/275, 363, 405

[56] References Cited

U.S. PATENT DOCUMENTS

| | | | |
|---|---|---|---|
| 4,483,485 | 11/1984 | Kamiya et al. | 239/585.4 |
| 4,564,145 | 1/1986 | Takada et al. | 239/585.4 |
| 4,597,558 | 7/1986 | Hafner et al. | 239/585.1 |
| 4,651,931 | 3/1987 | Hans et al. . | |
| 4,667,989 | 5/1987 | Dauna Bona | 285/405 X |
| 4,832,377 | 5/1989 | Umehara | 285/405 X |
| 4,915,350 | 4/1990 | Babitzka et al. | 239/585.4 X |
| 4,946,132 | 8/1990 | Reiter | 239/585.4 X |
| 4,967,966 | 11/1990 | Babitzka et al. | 239/585.4 |
| 4,984,744 | 1/1991 | Babitzka et al. | 239/585.4 |

*Primary Examiner*—William Grant

*Attorney, Agent, or Firm*—Edwin E. Greigg; Ronald E. Greigg

[57] ABSTRACT

An electromagnetically actuatable valve including an armature with a connecting part joined to a valve element. The magnet armature is provided with at least one recess including a shoulder on which a crimped portion of the connecting tube rests. The connecting tube is provided with a thickened portion likewise resting on the magnet armature. This creates a simple connection between the connecting tube and the magnet armature which requires no subsequent machining. The electromagnetically actuatable valve may be used as a fuel injection valve for fuel injection systems of mixture-compressing internal combustion engines having externally supplied ignition.

4 Claims, 2 Drawing Sheets

ARMATURE CONNECTION FOR AN ELECTROMAGNETICALLY ACTUATABLE VALVE

BACKGROUND OF THE INVENTION

The invention is based on a valve as generically defined hereinafter. A valve is already known from U.S. Pat. No. 4,651,931, in which a magnet armature is made of solid material by boring and metal-cutting machining of the surface; the various manufacturing steps are very cost-intensive, and burrs must be removed from the most various locations. In addition, this known magnet armature is relatively heavy, so that there is an undesirable delay in the movement of the magnet armature upon energizing or de-energizing of the electromagnet, because of the larger mass that must be accelerated. To enable moving the valve closing member, the magnet armature must be welded to some connecting part, for instance, which in turn means that the contact faces must be machined beforehand. Another option for connecting the magnet armature and the connecting part is to press the material of the armature radially inward into annular grooves of the connecting part, but this undesirably makes for worse magnetic properties of the magnet armature.

OBJECT AND SUMMARY OF THE INVENTION

The valve according to the invention has an advantage over the prior art that it can be manufactured simply and at favorable cost, with a least possible intrinsic weight. With non-chip-removing shaping or joining methods, deburring operations become unnecessary, and because of the low weight very short response times upon energizing or de-energizing of the electromagnet are attained. Connecting the magnet armature to the connecting part by welding or soldering can be dispensed with here, and it is unnecessary to clean the corresponding connecting faces and prepare them for the soldering or welding.

With a special embodiment of the connecting tube according to the invention, the armature can be made symmetrical; that is, fully automatic assembly is possible, because the position of the magnet armature need not be aligned in preparation for the connecting operation.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
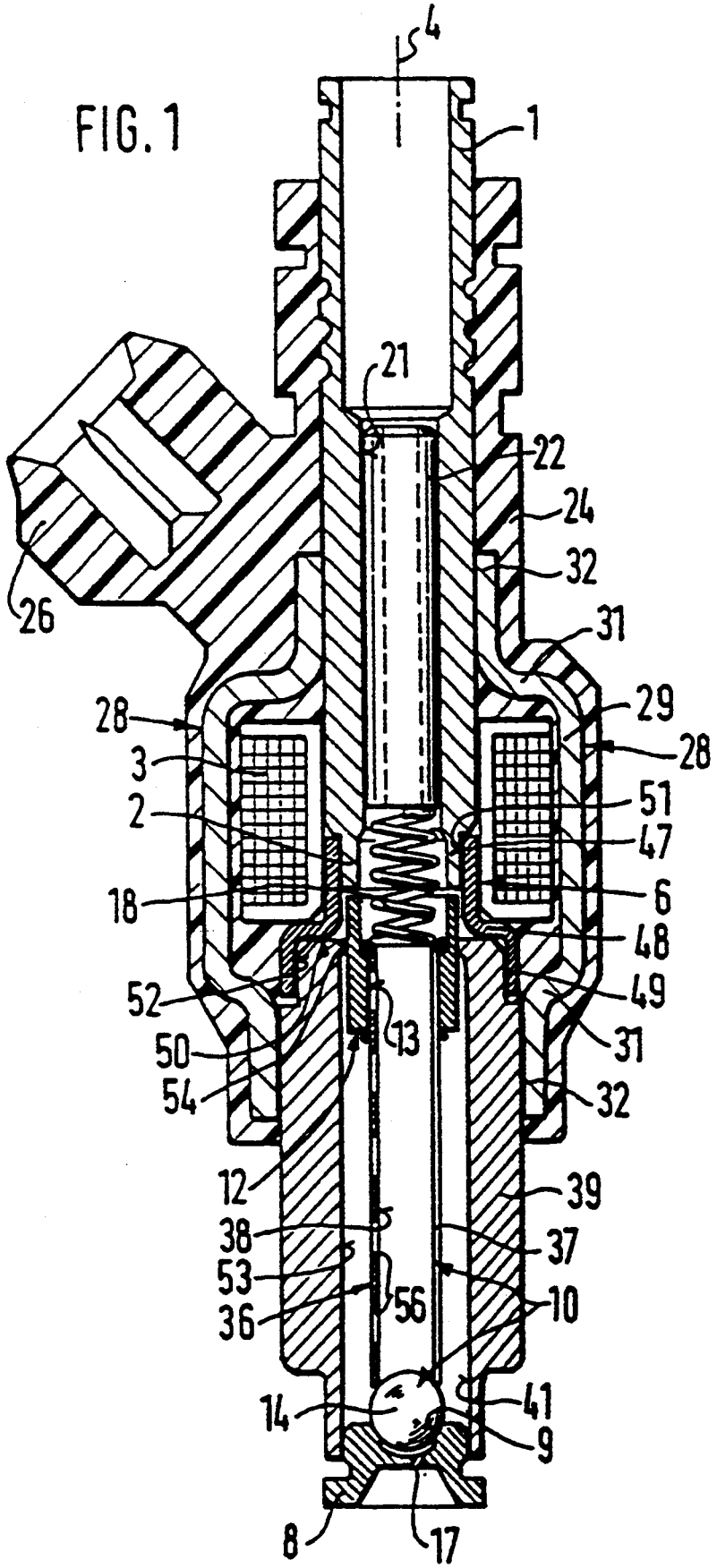
FIG. 1 shows an electromagnetically actuatable fuel injection valve embodied in accordance with the invention.

The electromagnetically actuatable valve shown as an example in FIG. 1, in the form of an injection valve for fuel as a component in a fuel injection system of a mixture-compressing internal combustion engine having externally supplied ignition has a tubular metal connection neck 1 of ferromagnetic material including a lower end 2 which is surrounded by a magnet coil 3.

The connection neck 1 thus simultaneously serves as a core. Adjoining the core end 2 of the connection neck 1, concentrically with the longitudinal axis 1 of the valve, an intermediate part 6 is tightly joined to the connection neck 1, for instance by soldering or welding. The intermediate part 6 is made of nonmagnetic deep-drawn sheet metal, which has a first connecting portion 47 extending coaxially to the longitudinal valve axis 4 and which portion 47 completely surrounds the core end 2 and is tightly joined to the core end 2. A collar 48 extending radially outward from the first connecting portion 47 leads to a second connecting portion 49 of the intermediate part 6, which extends coaxially with the longitudinal valve axis 4 and in the axial direct on protrudes partway beyond a connecting part 39 to which it is tightly joined on its inner surface, for example by soldering or welding. The diameter of the second connecting portion 49 is thus larger than the diameter of the first connection portion 47, so that in the assembled state the tubular connecting part 39 rests with an end face 50 on the collar 48. To make small valve dimensions possible, the first connecting portion 47 surrounds a retaining step 51 of the core end 2 that has a smaller diameter than the connection neck 1, while the second connecting portion 49 surrounds a retaining step 52, likewise embodied with a smaller diameter than in the adjoining region, of the connecting part 39.

Remote from the end face 50, the connecting part 39, made of ferromagnetic material, has a retaining bore 41 into which a valve seat body 8 is tightly inserted, for example by means of screwing, welding or soldering. The retaining bore 41 merges with a transition bore 53, which is adjoined in the vicinity of the end face 50 by a slide bore 54, into which a magnet armature 12 protrudes and by which the magnet armature 12 is guided. Thus, the retaining bore 41 and the slide bore 54 can be made in the same chuck during manufacture, resulting in bores that are accurately aligned with one another. The magnet armature 12 is guided neither by the intermediate part 6 nor by the transition bore 53 of the connecting part 39. In comparison with the axial length of the magnet armature 12, the axial length of the slide bore 54 is short, for instance being approximately one-fifth the length of the magnet armature.

Remote from the connection neck 1 but oriented toward the core end 2 of the connection neck 1, the metal valve seat body 8 has a fixed valve seat 9. The succession of the connection neck 1, intermediate part 6, connecting part 39 and valve seat body 8 forms a rigid metal unit. One end of a valve body 10 protruding into the transition bore 53 is inserted into and joined with a fastening opening 13 of the magnet armature 12; the valve body 10 includes both a thin-walled round connecting tube 36 and a valve closing member 14, which is connected to the other end, oriented toward the valve seat 9, of the connecting tube 36 and may for instance have the form of a sphere, hemisphere, or some other shape.

Remote from the valve closing member 14, a restoring spring 18 protrudes into the magnet armature 12, supported at one end on an end face of the connecting tube 36. The other end of the restoring spring 18 protrudes into a flow bore 21 of the connection neck 1, where it rests on a tubular adjusting bushing 22, which is screwed or pressed into the flow bore 21, for instance, in order to adjust the spring tension. At least part of the total axial length of the connection neck 1 and magnet coil 3 is surrounded by a plastic jacket 24, which also surrounds at least part of the intermediate part 6 and connecting tube 36. The plastic jacket 24 can be made by lining or extrusion-coating with plastic. An electrical connection plug 26 is simultaneously formed onto the plastic jacket 24, and by way of it the electrical contact of the magnet coil 3 and thus its energizing are accomplished.

The magnet coil 3 is surrounded by at least one guide element 28, extending in the axial direction over the entire length of the magnet coil 3, at least partly surrounding the magnet coil 3 circumferentially which is made of ferromagnetic material and serves as a ferromagnetic element for guiding the magnet field lines.

The guide element 28 has a curved middle region 29 adapted to the contour of the magnet coil, surrounding the magnet coil 3 only part way in the circumferential direction, and has end portions 31 that extend radially inward, which reach partly around the connection neck 1 and the connecting tube 39 on the other end, each merging with a respective axially extending shell end 32. In FIG. 1, a valve with two guide elements 28 is shown, which may be disposed opposite one another. For reasons of space, it may also be practical to have the electrical connection plug 26 extend in a plane that is rotated by 90°, or in other words is vertical to a plane through the guide elements 28.

It is possible to provide a slit 37 in the wall of the connecting tubes 36, radially penetrating this wall, as shown in FIG. 1. This slit 37 extends along the entire length of the connecting tube 36, and the fuel flows via the hollow magnet armature 12 into an internal conduit 38 of the connecting tube 36 and from there into the transition bore 53 and then to the valve seat 9. Downstream of this valve seat 9 in the valve seat body 8 there is at least one injection port 17, by way of which the fuel is injected into an intake tube or cylinder of an engine.

Figure 2:
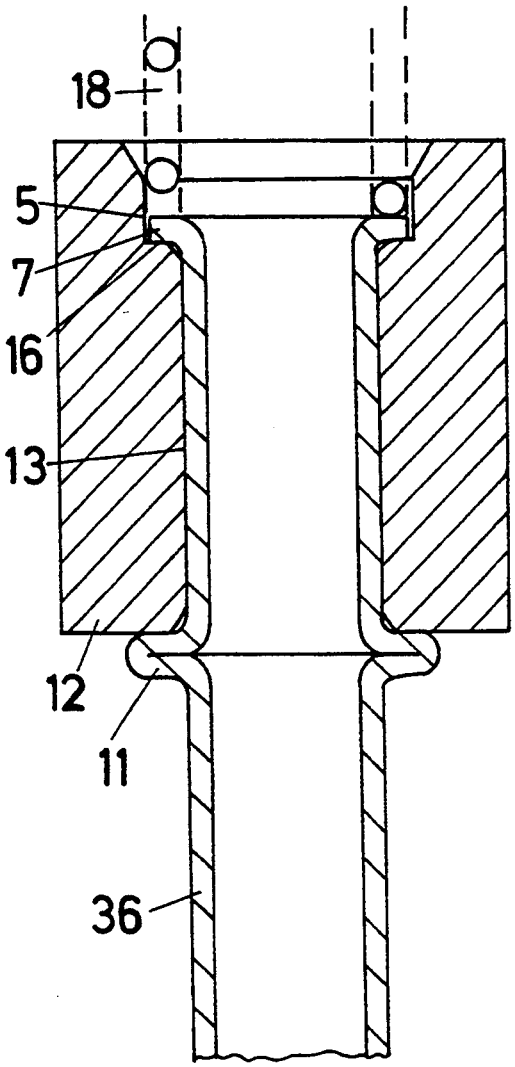
FIGS. 2 and 3 show a detail of FIG. 1, in two variant embodiments.

FIG. 2, in detail, shows the connection between the magnet armature 12 and the connecting tube 36. As can be seen from this figure, the armature 12 has a fastening opening through bore with a recess 5 at its upper end that via a shoulder 16 merges with the fastening opening 13 having a smaller cross section. The upper end of the connecting tube 36 is crimped, and this crimped portion 7 rests on the shoulder 16. As the drawing shows, the restoring spring 18 presses on this crimped portion. At the lower end of the magnet armature 12, the connecting tube 36 has a thickened portion 11 made by a deformation, which rests on the lower end of the magnet armature 12.

Figure 3:
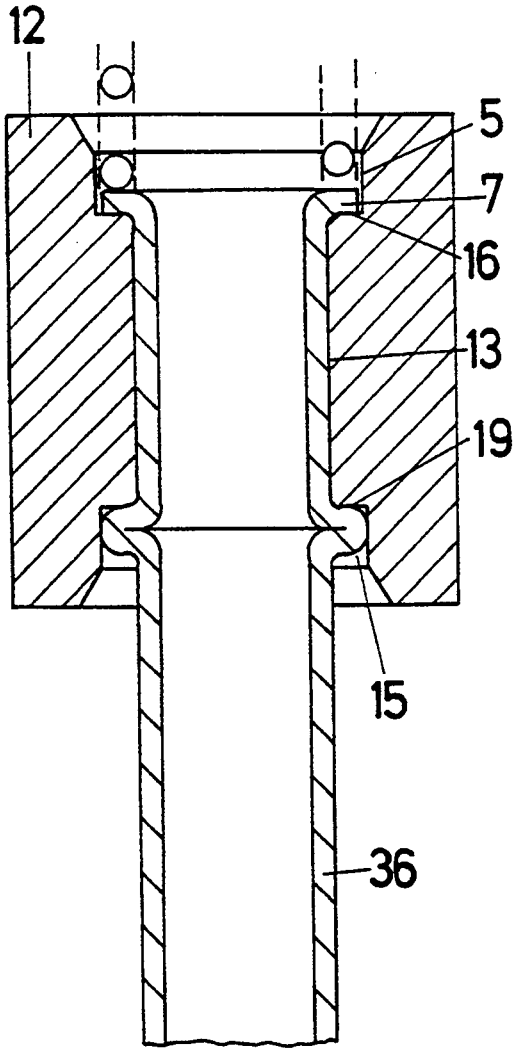

FIG. 3 she s modification of FIG. 2. Here the lower end of the magnet armature 12 also has a recess 15, which via a shoulder 19 merges with the smaller fastening opening 13, and it can be seen that the thickened portion 11 formed by deformation engages the inside of the recess 15 and rests on the shoulder 19. If the recesses 5 and 15 of the magnet armature 12 are embodied identically, then the magnet armature can be mounted arbitrarily, and a fully automatic assembly is made possible; that is, the position of the armature 12 need not be aligned for the connecting operation.

In the exemplary embodiments described, the magnet armature 12 and the connecting tube 36 are thus joined firmly to one another in a simple manner, without metal cutting and without welding or soldering, by means of the crimped portion 7 and the thickened portion 11 produced by deformation or folding of the connecting tube.

If a slit 37 is provided in the connecting tube 36, then it is favorable, in order to prevent an undesirable effect on the form of the stream of fuel injected from the injection port 17, which previously might possibly flow asymmetrically to the valve seat 9, to provide the connecting tube 36 with a plurality of flow openings 56, which penetrate the wall of the connecting tube 36, distributed symmetrically in the axial direction as well.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An electromagnetically actuatable fuel injection valve for fuel injection systems of mixture-compressing internal combustion engines with externally supplied ignition, which includes at least one core (1) surrounded by a magnet coil (3), toward which core a hollow magnet armature (12) having a through bore (13) is oriented, said hollow magnet armature includes an upper end and a lower end having a bottom end surface and is connected with a valve body (10) that extends toward a valve seat via a connecting tube (36), said hollow magnet armature (12) includes a first recess (5) in said upper end along said through bore (13), said first recess including a shoulder (16), said hollow magnet armature (12) is provided with a second recess (15) which extends upwardly from the bottom end surface of the lower end of said magnet armature along said through bore up to a shoulder (19), said connecting tube (36) includes a crimped portion (7) which rests on said shoulder (16) in said first recess of said magnet armature, said connecting tube (36) is provided with a thickened portion (11) axially spaced apart from said crimped portion (7) which rests on said shoulder (19) of said second recess in the hollow magnet armature (12) whereby said crimped portion (7) and said thickened portion secure said connecting tube with said hollow magnet armature.

2. A valve as defined by claim 2, in which said first and second recesses (5, 15) have identical diameters.

3. A valve as defined by claim 2, in which said hollow magnet armature (12) is symmetrically embodied.

4. A valve as defined by claim 1, in which said hollow magnet armature (12) is symmetrically embodied.

* * * * *